United States Patent [19]

Carroll et al.

[11] 4,106,625

[45] Aug. 15, 1978

[54] MOLDED CONTAINER

[75] Inventors: James C. Carroll, Hopkinsville, Ky.; Lewis T. Johnson, Bartlesville, Okla.

[73] Assignee: Phillips Petroleum Company, Bartlesville, Okla.

[21] Appl. No.: 825,739

[22] Filed: Aug. 18, 1977

[51] Int. Cl.[2] ..... B65D 21/04

[52] U.S. Cl. ..... 206/507; 206/501

[58] Field of Search ..... 206/505, 506, 507, 501, 206/513, 514; 211/126

[56] References Cited

U.S. PATENT DOCUMENTS

| | | | |
|---|---|---|---|
| D. 236,168 | 7/1975 | Johnson | D87/1 R |
| 2,994,463 | 8/1961 | Drader | 224/48 |
| 3,202,295 | 8/1965 | Drader | 211/126 |
| 3,392,875 | 7/1968 | Bockenstette | 206/507 |
| 3,425,594 | 2/1969 | Bridenstine | 206/507 |
| 3,627,163 | 12/1971 | Taylor | 220/6 |
| 3,675,815 | 7/1972 | Rehrig | 206/507 |
| 3,780,905 | 12/1973 | Herolzer | 206/507 |
| 3,819,044 | 6/1974 | Bockenstette | 206/507 |
| 3,865,239 | 2/1975 | Herolzer | 206/507 |
| 3,870,151 | 3/1975 | Johnson | 206/507 |
| 3,951,265 | 4/1976 | Carroll | 206/507 |
| 4,023,680 | 5/1977 | Thurma | 206/507 |

*Primary Examiner*—George E. Lowrance

[57] ABSTRACT

A stack and cross nest unitary molded tray is designed so that it will also stack and cross nest interchangeably with a tray having rod members for stacking.

4 Claims, 13 Drawing Figures

MOLDED CONTAINER

BACKGROUND OF THE INVENTION

The invention relates to a stacking and cross nesting container.

Containers of various kinds are widely used in handling and moving from one location to another various commodities, for example foodstuffs such as bakery products. It is highly desirable that such containers be durable, rigid, light in weight, easy to handle, easy to store when not in use and of simple and inexpensive construction thereby being simple to manufacture and economical in cost. In many applications unitary molded containers have proved to have a better combination of desirable features than metal trays previously used in the same service. However, where a large investment has been made in metal containers it is highly desirable that the unitary molded trays which replace existing metal trays be compatible with the metal trays so that they can be used interchangeably and intermixed during the interim period while the metal trays are serving out their useful life. Such compatibility and interchangeability permits the user to take advantage of the desirable combination of features of the unitary molded containers without incurring the liability for immediate scrapping and replacement of a large number of metal trays.

The present invention provides a unitary molded tray which has a very desirable combination of features and which is compatible and interchangeable with a metal tray which is widely used in the baking industry.

SUMMARY OF THE INVENTION

According to the invention a unitary molded container comprises vertical end walls having upper shoulders and lower saddles permitting vertical stacking, side walls which are longer and lower than the end walls thus permitting cross nesting and transverse saddles in the horizontal shoulders to permit stacking with existing metal trays of a different configuration.

Description of Preferred Embodiment

Figure 1:
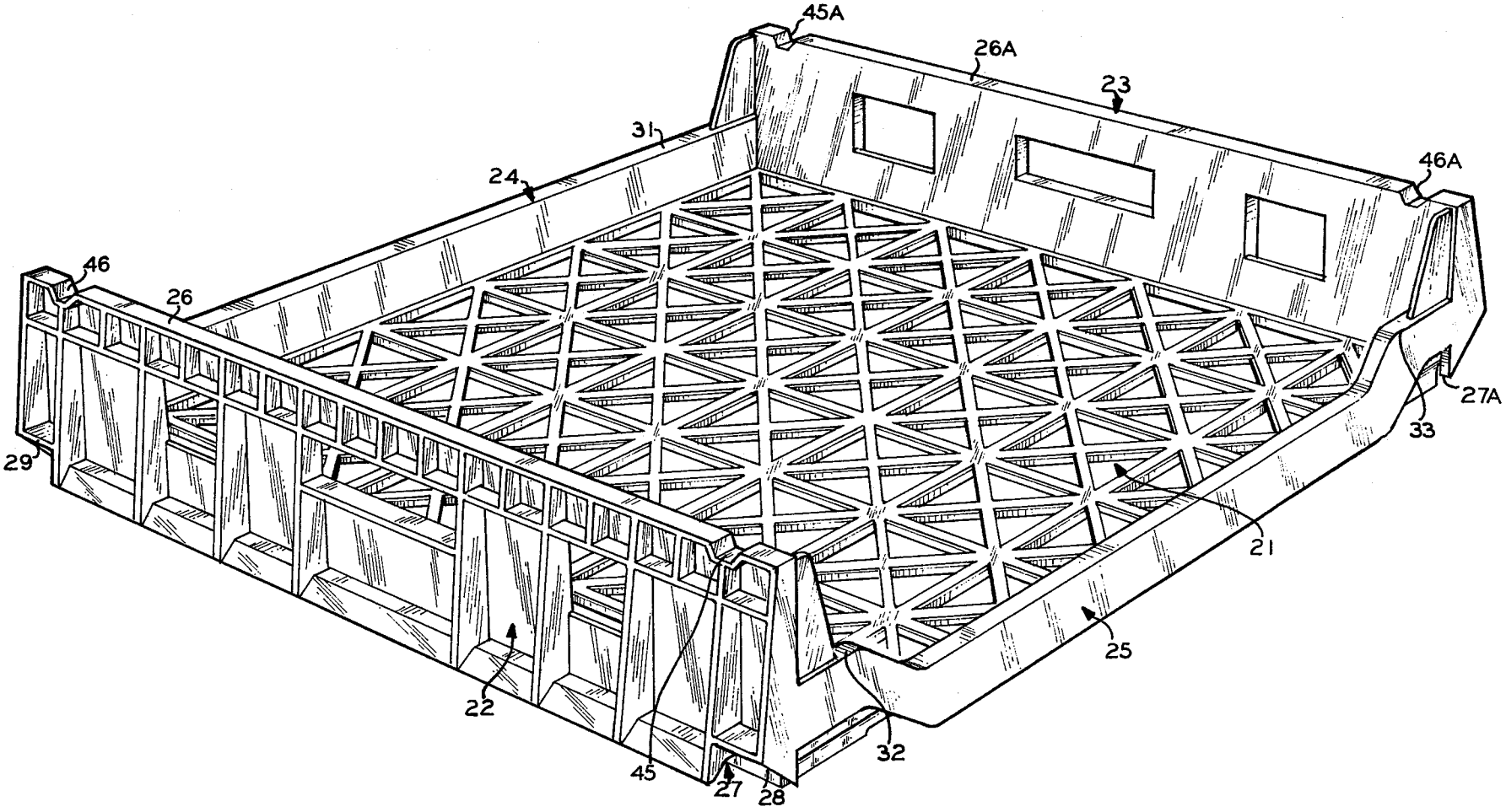
FIG. 1 is a pictorial view of a tray according to the invention.
Figure 2:
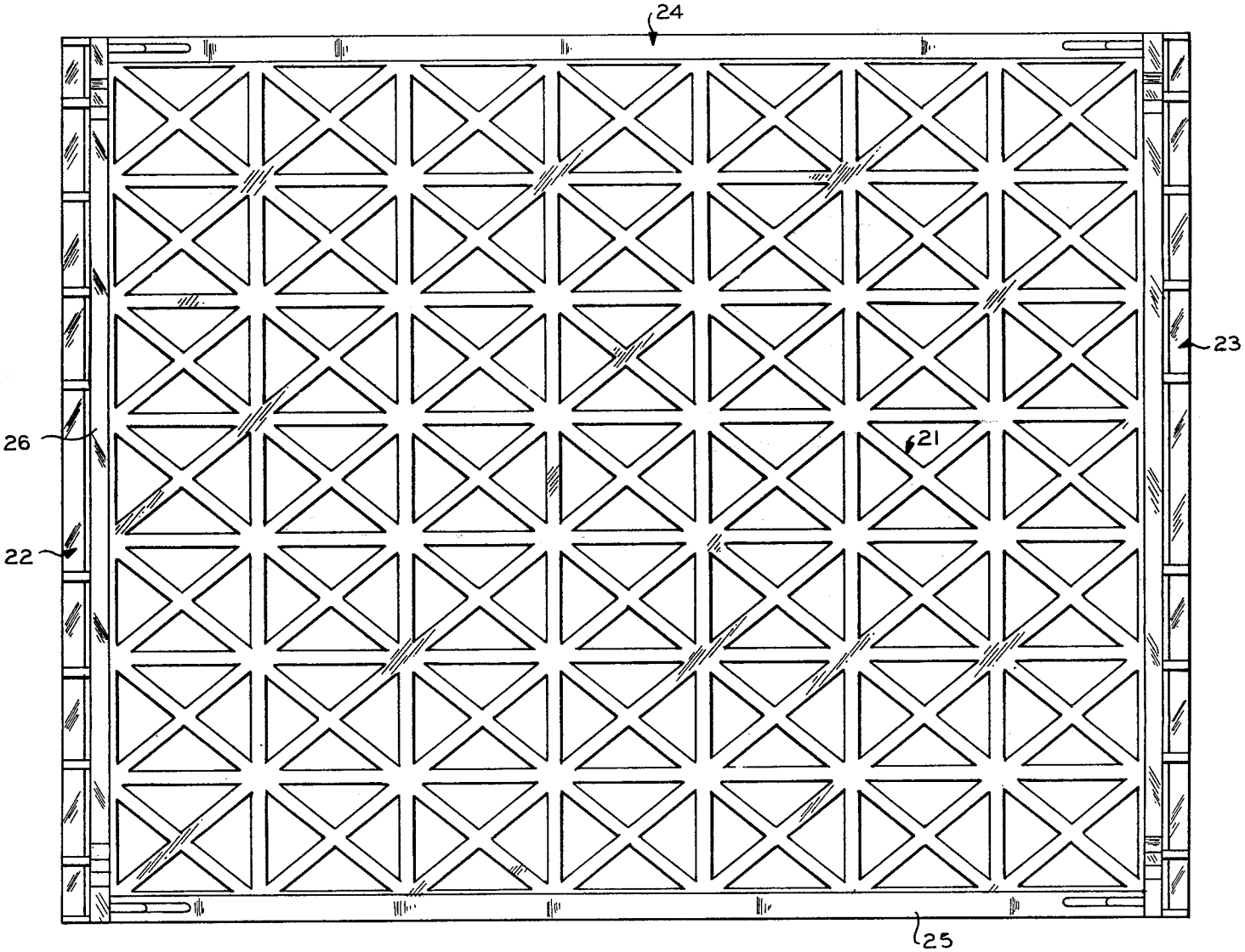
FIG. 2 is a top plan view of the tray of FIG. 1.
Figure 3:
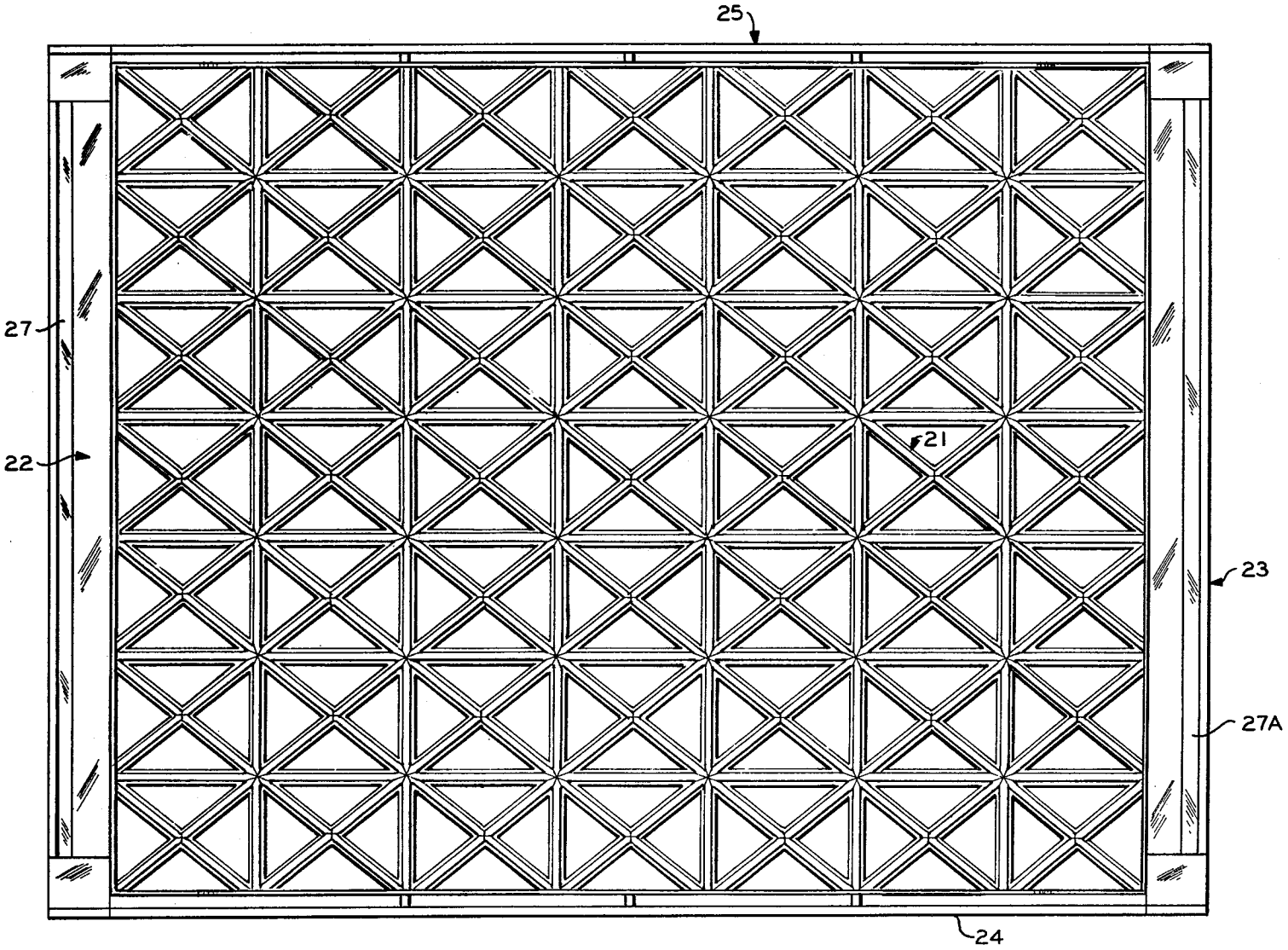
FIG. 3 is a bottom plan view of the tray of FIG. 1.
Figure 4:
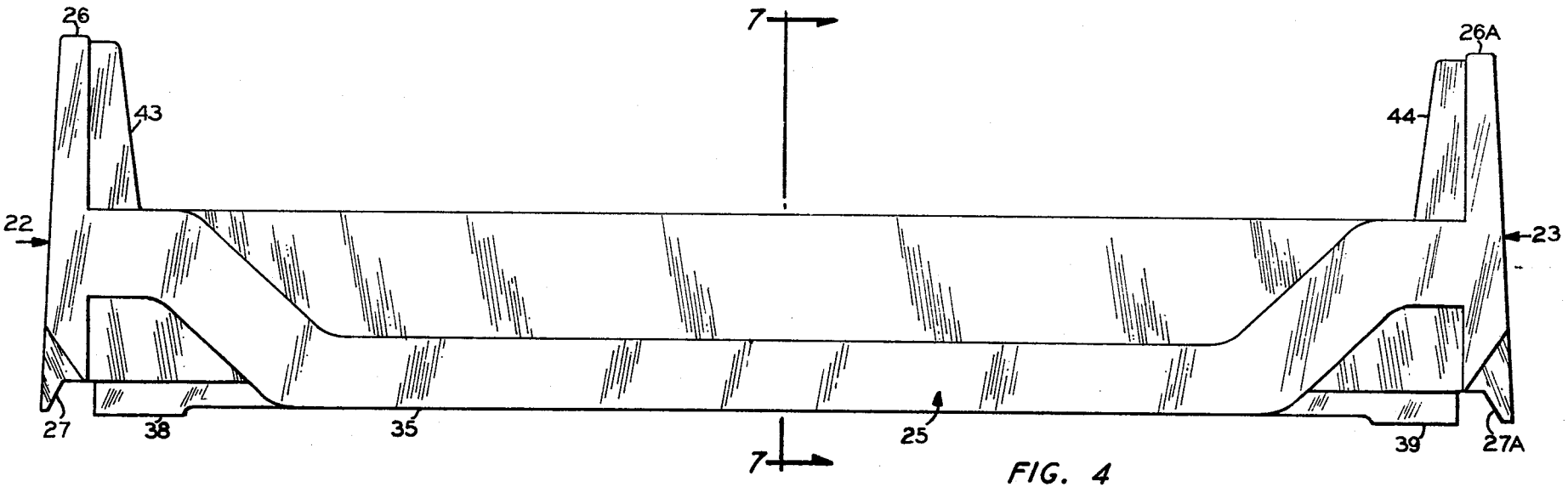
FIG. 4 is a right elevation of the tray of FIG. 1.
Figure 5:
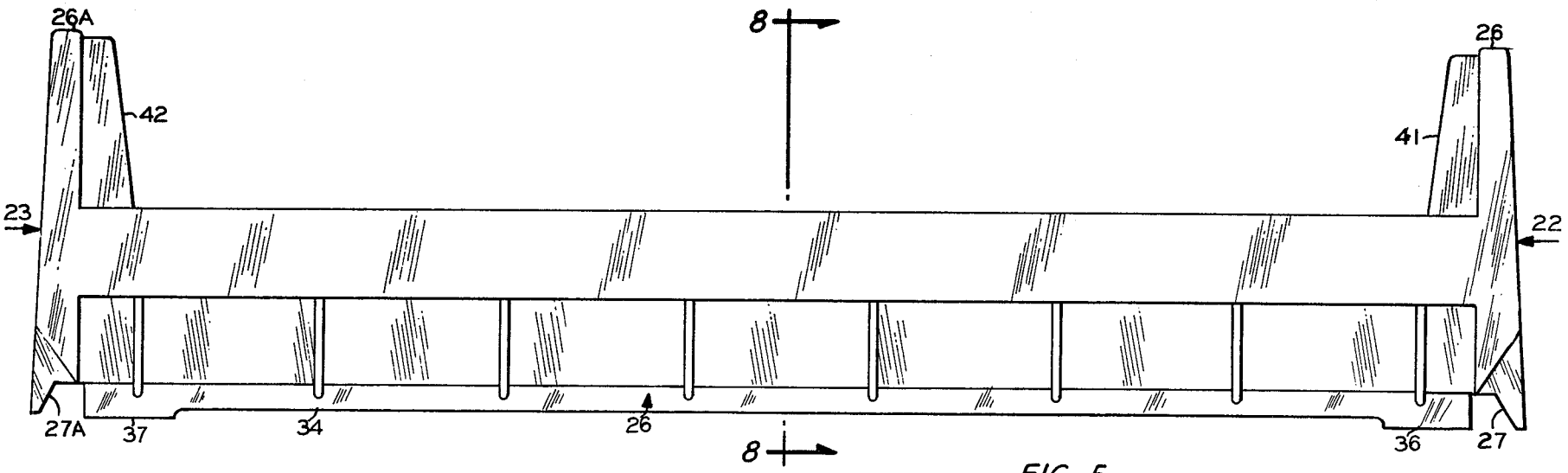
FIG. 5 is a left elevation of the tray of FIG. 1.
Figure 6:
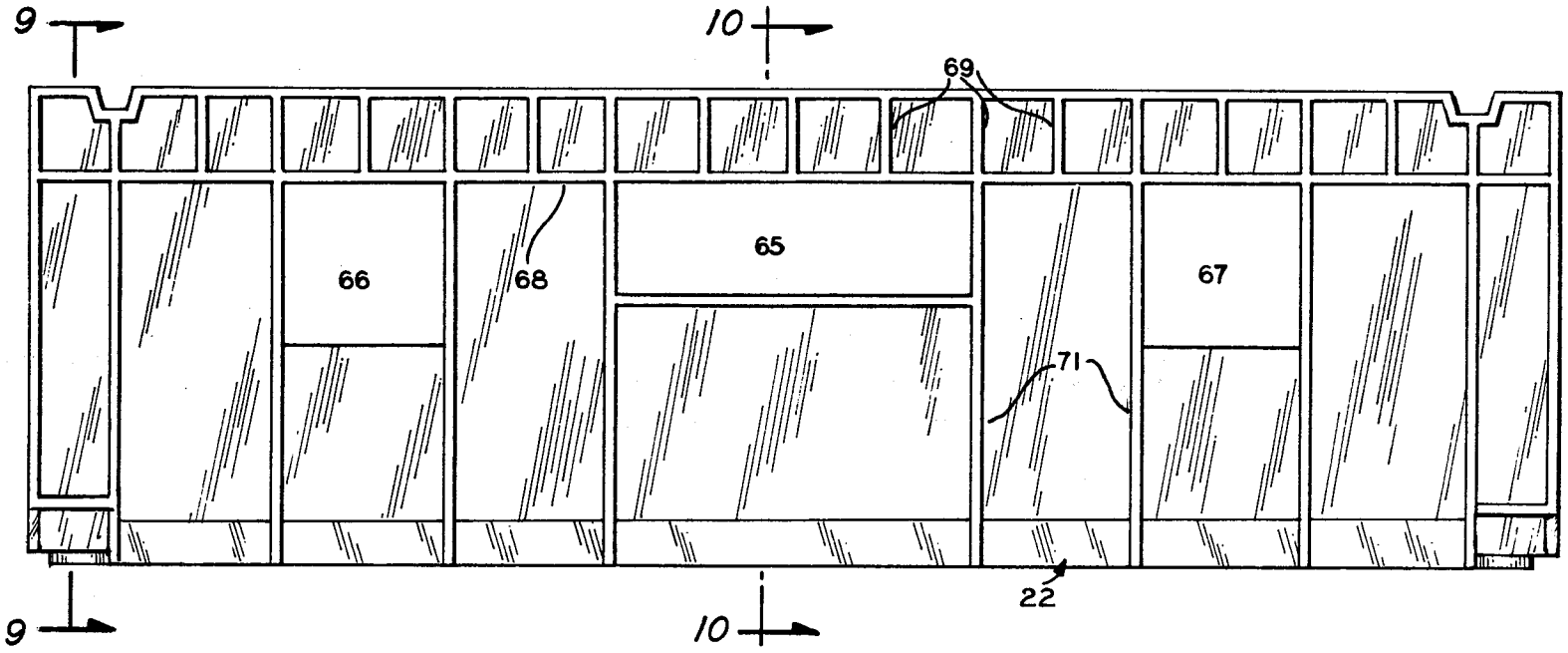
FIG. 6 is an end elevation of the tray of FIG. 1.

As illustrated in FIG. 1, the tray of the invention comprises a rectangular bottom 21 which connects a pair of vertical end walls 22 and 23 and first and second side walls 24 and 25. In the embodiment illustrated each of the end walls 22 and 23 has a horizontal shoulder 26 and 26A, respectively, forming the upper edge thereof and an elongated horizontal saddle 27 and 27A formed on the lower portion thereof.

Horizontal saddles 27 and 27A terminate short of the ends of the end walls 22 and 23 thereby providing recesses 28 and 29 in end wall 22, and corresponding recesses in end wall 23.

Side walls 24 and 25 are horizontally longer and vertically shorter than end walls 22 and 23 and have horizontal support ledges 31, 32 and 33, whereby when a like tray is rotated 90° with its side walls parallel with the end walls and placed on top of a lower tray the upper tray nests within the lower tray with the lower edge 34 of side wall 24 and lower edge 35 of side wall 25 resting on the horizontal support ledges. Lower edge 34 includes downwardly extending feet 36 and 37 and lower edge 35 includes downwardly extending feet 38 and 39. The distance between feet 36 and 37 is equal to the distance between feet 38 and 39 and slightly greater than the horizontal distance from the outer edge of horizontal support ledge 31 and the outer edges of horizontal support ledges 32 and 33 and thus, in nested position, the downwardly extending feet prevent accidental lateral movement of the nested tray, as illustrated in FIG. 13.

Figure 13:
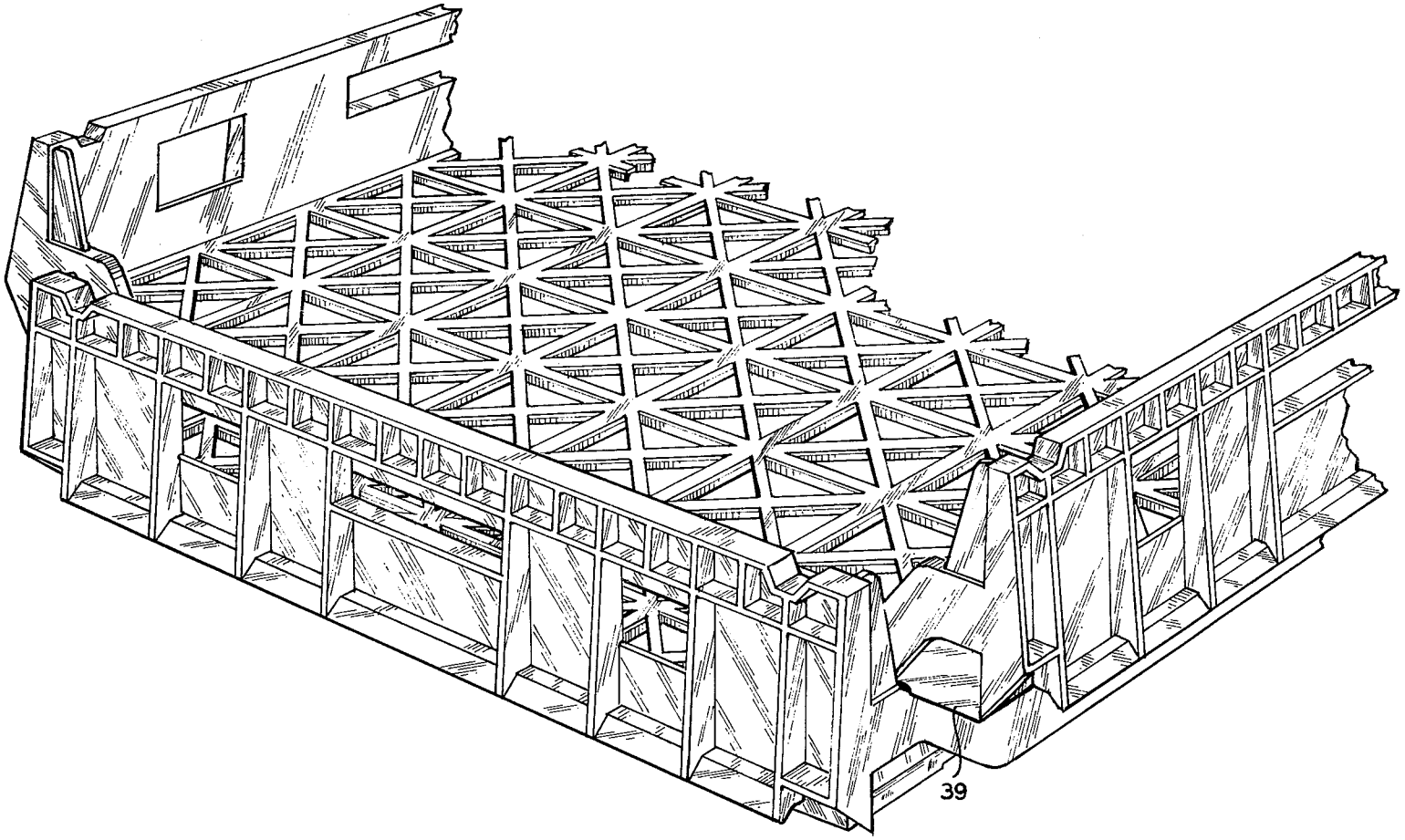
FIG. 13 shows two trays of the type illustrated in FIG. 1 in nesting relationship with each other.

As can be seen clearly in FIG. 13 the height of horizontal support ledges 32 and 33 is such that, when the trays are in nested position, these support ledges do not extend vertically high enough to interfere with stacking a third tray on top of two nested trays and oriented with the lower of the two nested trays. Thus, by alternately rotating trays 90°, a stack of trays can be formed having intermediate nested trays thus permitting twice as many trays to be accommodated in the same space when nested as when stacked.

Food products, such as baked goods, can be accommodated in the trays illustrated both in the nested and stacked position. For relatively flat goods such as for example baked rolls, the trays can be placed in nested position while with relatively high products such as loaves of bread, the trays can be used in stacked position only. The nested position also is useful for transporting empty trays with a minimum of wasted space.

Figure 12:
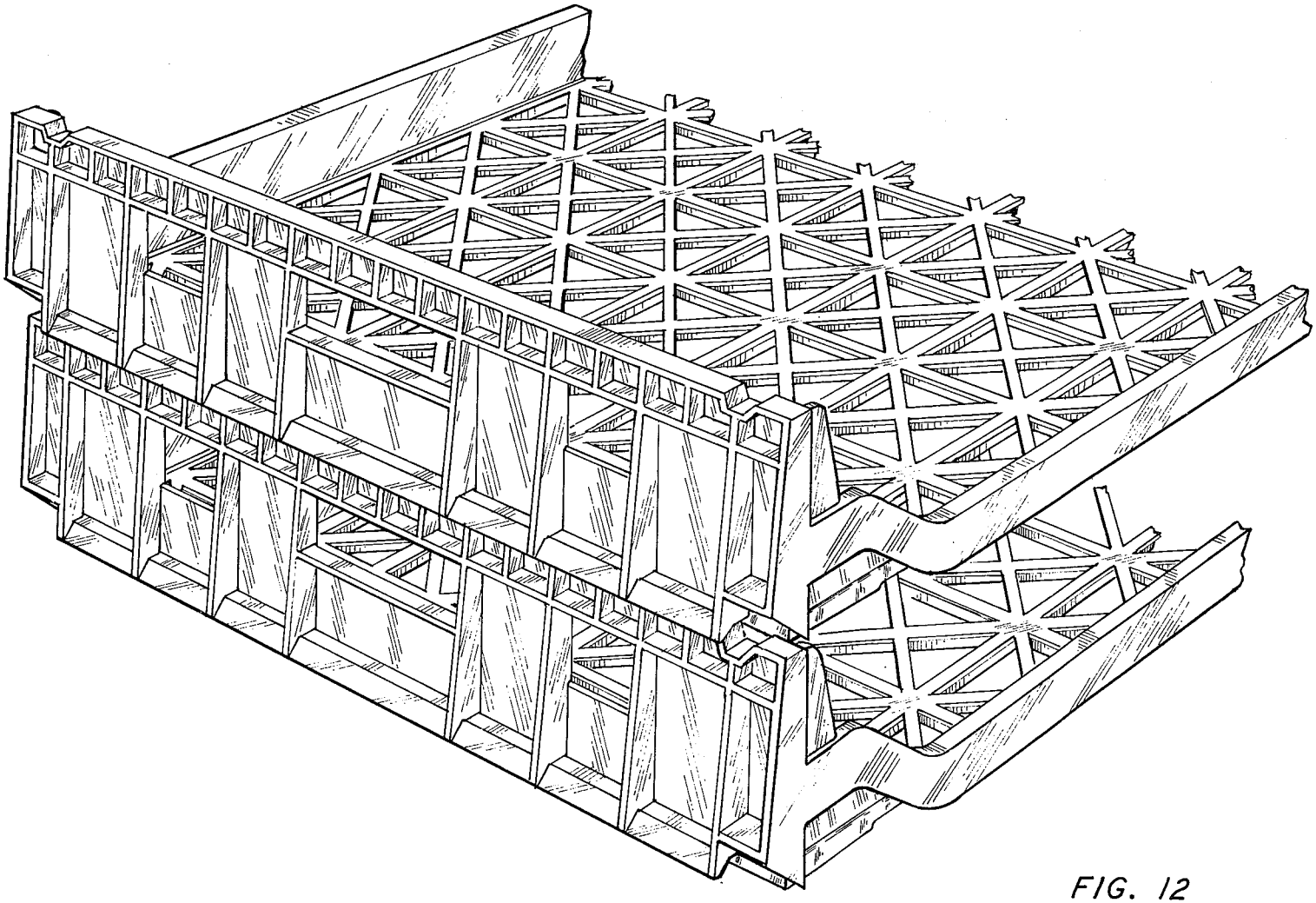
FIG. 12 shows two trays of the type illustrated in FIG. 1 in stacking relationship with each other.

Side walls 24 and 25 are provided with vertical stops 41 and 42 and 43 and 44, respectively. Horizontal saddles 27 are located in the same vertical plane as horizontal shoulders 26 and therefore, when a tray of the invention is placed directly on top of a like oriented tray saddles 27 rest on shoulders 26. In this position the downwardly extending feet 36 and 37 extend downwardly inside vertical stops 41 and 42, respectively and feet 38 and 39 extend downwardly inside stops 43 and 44, thereby preventing accidental lateral movement of trays which are in stacked relation. This can best be seen in FIG. 12.

Horizontal shoulder 26 is provided with a pair of transverse saddles 45 and 46 and horizontal shoulder 26A with corresponding transverse saddles 45A and 46A.

Figure 11:
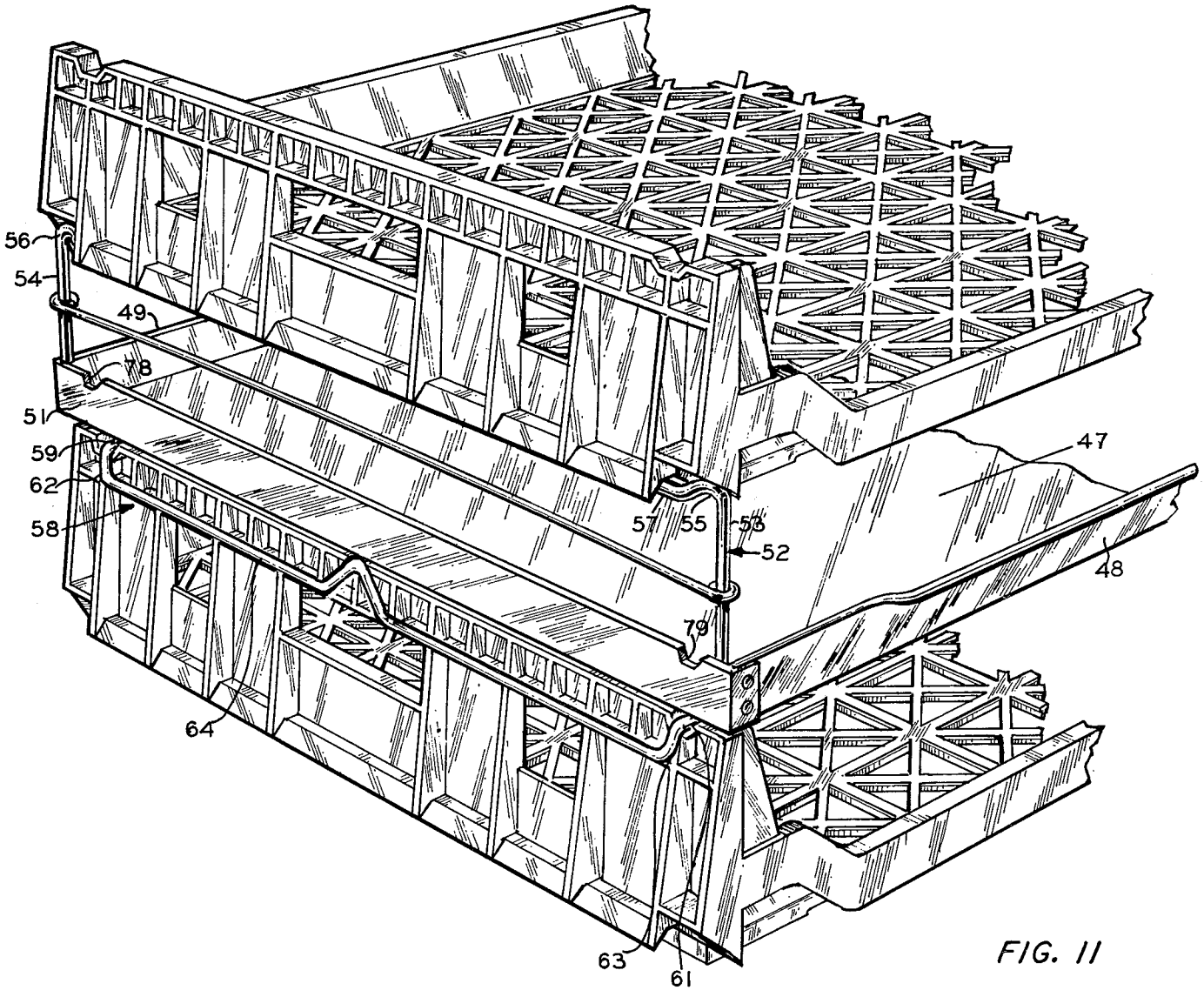
FIG. 11 shows two trays of the type illustrated in FIG. 1 in stacking relationship with a metal tray of the prior art.

The metal tray with which the tray of the present invention is designed to be compatible is illustrated in FIG. 11 in stacked position with two trays of the invention. This metal tray includes a bottom member 47 and upwardly extending side elements 48, 49 and 51. Extending upwardly at the end of the metal tray is a metal rod 52 bent to form legs 53 and 54, upwardly extending bends 55 and 56 and straight horizontal portion 57. Extending below the bottom and side members of the metal tray is a metal rod 58 which includes lateral portions 59 and 61, downwardly extending portions 62 and 63 and a horizontal portion 64. A tray of the type illustrated in FIG. 11 is disclosed in U.S. Pat. No. 2,994,463.

As can be seen in FIG. 11 trays according to the present invention are completely compatible and interchangeable with the trays of the type of U.S. Pat. No. 2,994,463 in stacked position in which position lateral portions 59 and 61 of rod 58 rest in lateral saddles 45 and 46, with horizontal portion 64 lying outside but adjacent to the outer portion of end wall 22, while saddle 27 of an upper tray rests on horizontal portion 57 of rod 52. The upwardly extending bends 35 and 36 are accommodated by recesses 28 and 29, respectively. Upwardly extending bends 35 and 36 on the one hand and recesses 28 and 29 on the other hand prevent accidental lateral movement of the stacked trays.

Each of end walls 22 and 23 also is provided with a hand hole 65 and a pair of side openings 66 and 67. A horizontal rib 68 extends across the face of end 22 and is connected with shoulder 26 by a plurality of vertical ribs 69. Additional vertical ribs 71 connect horizontal ribs 68 with the lower portion of end 22 which forms saddle 27.

Figure 7:
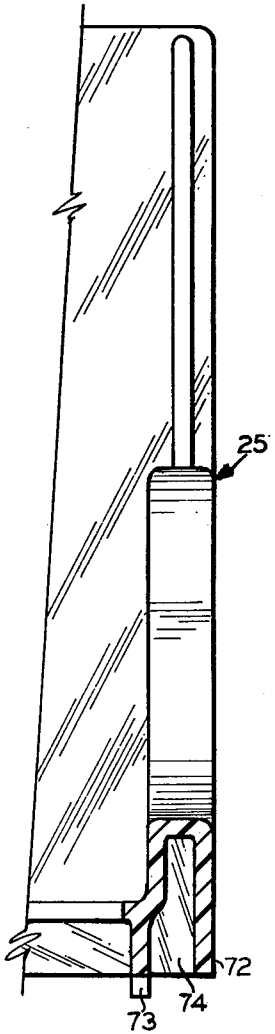
FIG. 7 is a cross section along the line 7—7 of FIG. 4.

As shown more clearly in FIG. 7, the side 25 in cross section includes an outer wall 72 and an inner wall 73. A plurality of ribs 74 reinforce walls 72 and 73.

Figure 8:
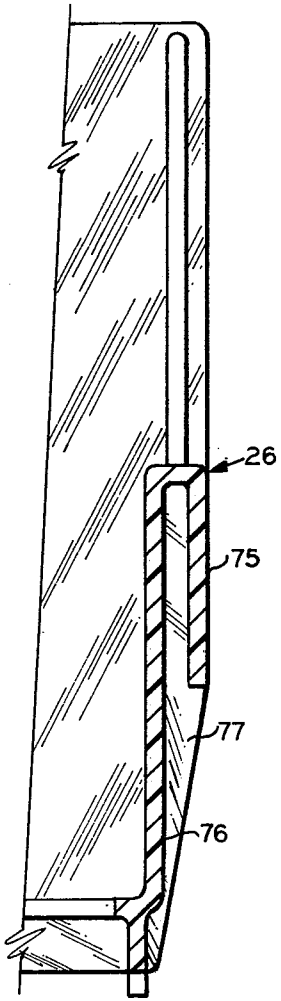
FIG. 8 is a cross section along the line 8—8 of FIG. 5.

As shown in FIG. 8 side 26 also has an outer wall portion 75 and an inner wall portion 76 and a plurality of ribs 77 reinforce walls 75 and 76.

Figure 10:
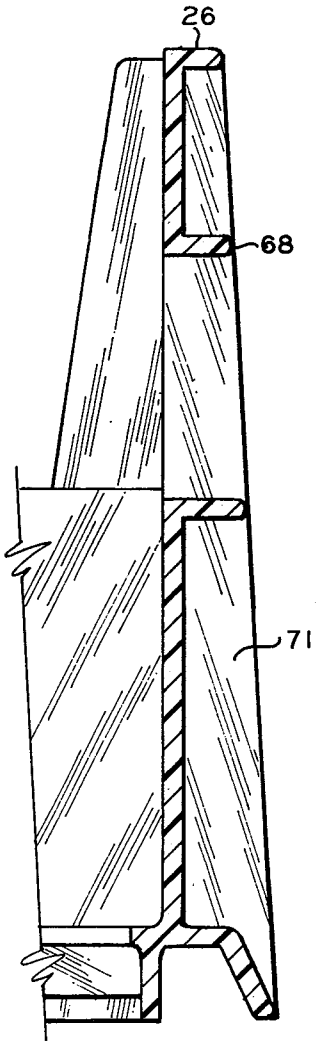
FIG. 10 is a cross section along the line 10—10 of FIG. 6.
Figure 9:
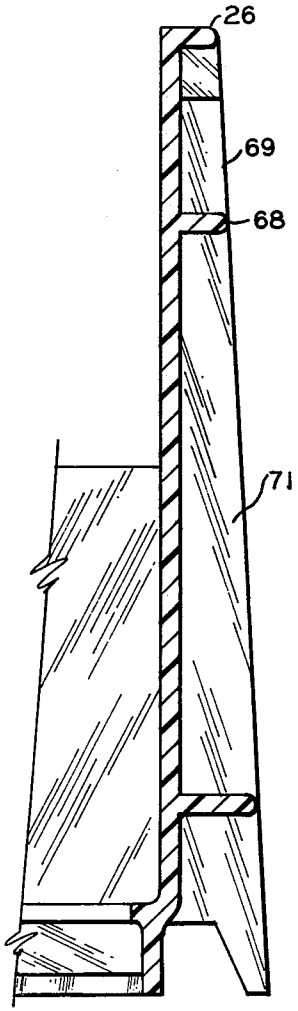
FIG. 9 is a cross section along the line 9—9 of FIG. 6.

FIGS. 9 and 10 show typical cross sections of wall 22 including shoulder 26, horizontal ribs 68 and vertical ribs 69 and 71.

Although not specifically illustrated in the drawing the container of the invention can be proportioned to stack with a metal tray of the type illustrated in FIG. 11 in a low stack configuration. Metal trays of this type can be and often are constructed so that the metal rod 52 can be rotated to a horizontal position lying flat in the bottom of the tray whereby similar metal trays can stack in a low position, with metal rod 58 resting in the notches 78 and 79 of side element 51. The unitary molded tray of the invention will stack on such a metal tray with rod 52 in the rotated (horizontal) position when walls 73 and 76 are spaced to fit just inside side elements 48 and 49 with outer walls 72 and 75 lying outside the vertical plane of walls 48 and 49. For best results ribs 74 and 76 should have cut out portions near the lower ends thereof to permit the molded tray to telescope vertically to the extent necessary to permit saddles 27 to engage the upper portion of side elements 51. Details of the mechanism of the metal trays whereby rods 52 can be folded to a horizontal position are disclosed in U.S. Pat. No. 2,994,464 referred to above which is incorporated herein by reference.

In the preferred configuration illustrated in the drawing, bottom 21 is formed of a plurality of longitudinal, transverse and diagonal members which are T-shaped in cross section with the leg of the T facing toward the bottom of the container leaving a smooth surface on the top of rectangular bottom 21.

What is claimed is:

1. A unitary molded tray comprising:

a pair of vertical end walls, first and second side walls and a horizontal bottom connecting said end walls and said side walls;

a horizontal shoulder forming the upper edge of each of said end walls;

an elongated horizontal saddle formed on the lower portion of each of said end walls said elongated horizontal saddle terminating short of the ends of said end walls thereby providing recesses at each said end, said elongated horizontal shoulder and elongated horizontal saddle on each of said end walls being located in the same vertical plane whereby one said tray stacks on a second said tray when said one tray is placed above said second tray with said end walls of said one tray directly over said end walls of said second tray;

said side walls being horizontally longer and vertically shorter than said end walls and having horizontal support ledges on their upper surfaces whereby said one tray nests within said second tray and rests upon said ledges when oriented with its side walls parallel with the end walls of said second tray; and a pair of transverse saddles formed in each of said horizontal shoulders whereby said one tray stacks on a third tray having a horizontal upper rod member having vertically upraised portions on each end thereof, said elongated horizontal saddle resting on said rod member with the upraised portions thereof within said recesses and said transverse saddles accept a pair of rod members extending at right angles to the ends of said third tray permitting said third tray to be stacked on said second tray.

2. A tray according to claim 1 wherein said side walls include vertical stops which engage lower edges of the side walls of an upper stacked tray to prevent lateral movement thereof.

3. A tray according to claim 1 wherein said elongated horizontal saddles are formed by outer and inner walls, said outer walls sloping outwardly toward the open ends of said horizontal saddles and said inner walls being substantially vertical.

4. A tray according to claim 3 wherein said side walls include vertical stops which engage lower edges of the side walls of an upper stacked tray to prevent lateral movement thereof.

* * * * *